United States Patent [19]

Stoffel

[11] 4,358,944

[45] Nov. 16, 1982

[54] UNITARY KEY HOLDER

[75] Inventor: John F. Stoffel, Eastchester, N.Y.

[73] Assignee: Stoffel Seals Corporation, Tuckahoe, N.Y.

[21] Appl. No.: 187,902

[22] Filed: Sep. 17, 1980

[51] Int. Cl.[3] ..... A47G 29/10

[52] U.S. Cl. ..... 70/457; 70/458

[58] Field of Search ..... 70/456–459; 24/201 C, 204; 292/307, 317–321; 150/40

[56] References Cited

U.S. PATENT DOCUMENTS

| | | | |
|---|---|---|---|
| D. 220,597 | 4/1971 | Balzano . | |
| 2,599,700 | 6/1952 | DiPalma . | |
| 2,800,349 | 12/1957 | Moberg . | |
| 3,111,152 | 11/1963 | Goessling . | |
| 3,503,235 | 3/1970 | Field | 70/456 R |
| 3,529,649 | 9/1970 | Bennett . | |
| 3,568,482 | 3/1971 | Shears | 70/457 |
| 3,908,418 | 9/1975 | Stoffel | 70/456 R |
| 4,037,716 | 7/1977 | Marks . | |

*Primary Examiner*—Robert L. Wolfe

*Attorney, Agent, or Firm*—Dowell & Dowell

[57] ABSTRACT

Apparatus for holding small articles such as keys and which includes a body having a pair of generally similar members that are hinged together and are movable into abutting relationship with each other. A retainer has one end attached to one member and the opposite end is removably attached in a recess or recesses in one or both members immediately adjacent to the hinge so that the articles may be easily connected to or removed from the retainer when the members are spread apart. Means is provided for holding the members in abutting relationship and such members may be separated by bending one member relative to the other.

8 Claims, 6 Drawing Figures

Fig. 1
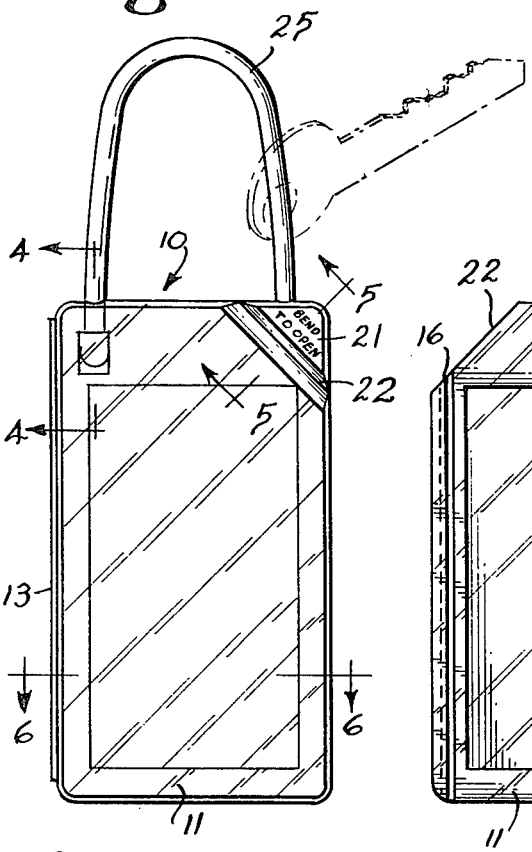
Fig. 2
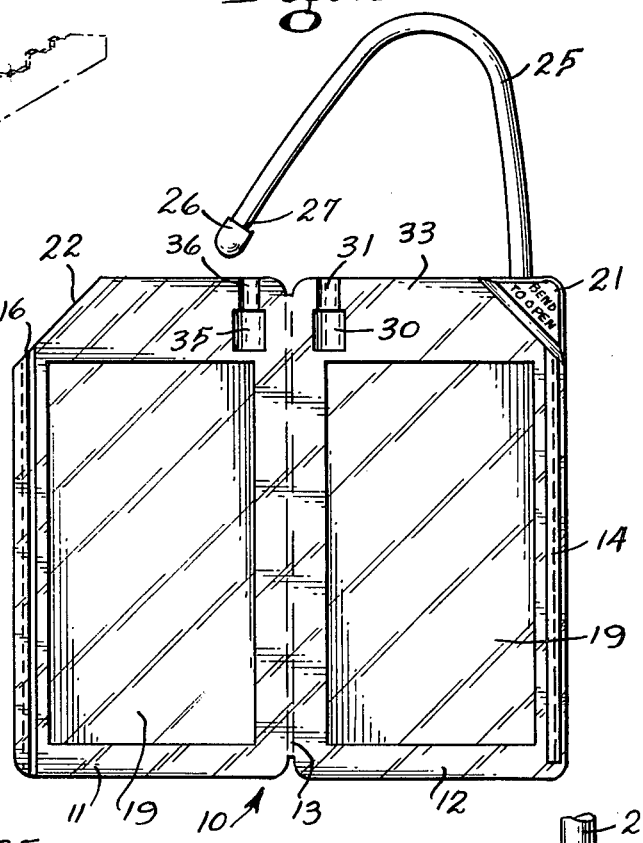
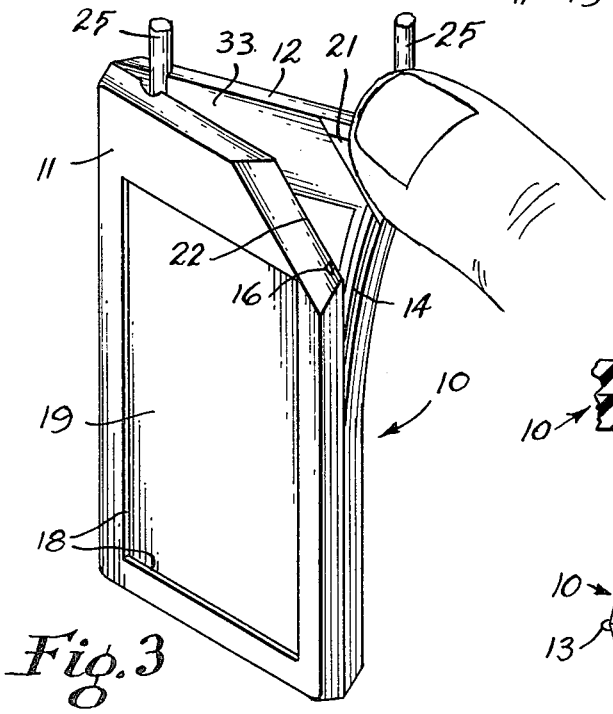
Fig. 3
Fig. 4
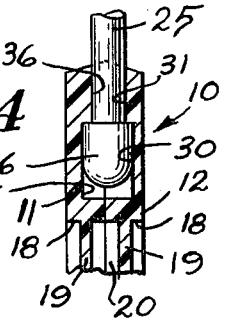
Fig. 5
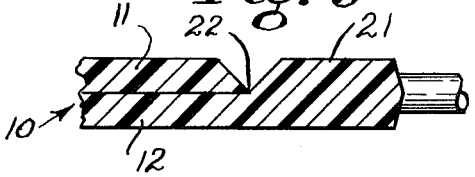
Fig. 6
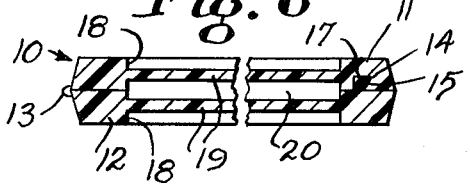

UNITARY KEY HOLDER

BACKGROUND OF THE INVENTION

1. Field of the Invention

This invention relates to article holders and particularly to a key holder on which one or more keys are removably mounted.

2. Description of the Prior Art

Devices for removably engaging and retaining various small articles such as keys have included key chains with the ends received within a connector and various devices such as clips, split rings and the like which could be spread apart to insert or remove the keys. A flexible device of this type has been described in my U.S. Pat. No. 3,908,418 as well as in various patents referred to therein.

Another patent, namely Goesling U.S. Pat. No. 3,111,512, discloses a key holder which is hinged at the side and has one end fixed to one of the sides and the other engaging a post and is retained when the two sides are clasped together.

SUMMARY OF THE INVENTION

The present invention is embodied in a key holder of unitary construction which is made of flexible resilient material and which includes a pair of body members connected by integral hinge portions along their sides. These body members may have recessed portions for receiving identifying indicia or storing a coin or other matter. One end of a flexible resilient key retainer is integrally connected to one of the body members, and the other end is removably received within a configured recess in either or both body members so that in closed position the body members cooperate to hold the end of the retainer. The configured recesses are adjacent to the hinged side of the members so that when the device is closed leverage is applied to hold the other end of the retainer. To assist in opening the members, the corner of one member remote from the hinge may be removed and the corner of the other member is enlarged thereby exposing both sides of the corner portion of the other to facilitate its being flexed away from the first member.

It is an object of the invention to provide a unitary key holder having a body including a pair of members connected by a hinge and with one end of a key retainer integrally formed therewith and the opposite end of such retainer is received between cooperating complementary configured recesses in the members adjacent to the hinged connection and one of the members having an enlarged exposed corner, whereby keys may be easily mounted on or removed from the retainer and its facing members easily separated from the closed position.

BRIEF DESCRIPTION OF THE DRAWINGS

FIG. 1 is a plan view of the key holder in closed position.

FIG. 2 is a plan view of the key holder in open position.

FIG. 3 is a perspective illustrating the manner of bending back a corner of the rear member of the holder in order to separate the members.

and

FIGS. 4, 5 and 6 are sections to enlarged scale on the lines 4—4, 5—5, and 6—6 of FIG. 1, respectively.

DESCRIPTION OF THE PREFERRED EMBODIMENT

With further reference to the drawings, a body 10 is provided having a first member 11 and a second member 12 connected together along adjacent side edges by an integral hinge 13. Each of the members 11 and 12 may be of any desired configuration; however, a generally thin flat rectangular configuration having inner and outer faces defined by side walls and end walls has been found satisfactory.

The members 11 and 12 of the body may be closed about the hinge 13 so that the inner faces of the members are in abutting relationship, as indicated in FIG. 1. The members 11 and 12 may be opened from each other, as illustrated in FIG. 2.

The body 10 preferably is formed of flexible and resilient thermoplastic synthetic organic polymeric resin material as an integral molding and ordinarily is either transparent or translucent in order that a card having indicia thereon may be seen through either or both of the members. Alternatively, it may be opaque or colored so that the contents of the cavity 20 are not visible.

In order to connect the members 11 and 12 in facing relationship as indicated in FIG. 1, they are provided with interengaging portions along their edges. By way of example, one of the members, such as the second or (as illustrated) rear member 12, has a dovetail type rib 14 extending outwardly from the inner face thereof, such rib being integrally connected to the inner face by a reduced neck portion 15. As shown in FIGS. 2 and 6, the rib 14 is spaced inwardly from the side edge of the member 12 a short distance.

The first or (as illustrated) front member 11 is provided with a groove 16 in its inner face leading to an enlarged recess 17 of a configuration cooperatively to receive the rib 14 of the second member. Due to the resilient nature of the material when the members 11 and 12 are forced toward each other, the rib 14 is compressed and the groove 16 is enlarged to permit the rib to pass through the groove into the recess 17 where it is held by a close fit, due to the resiliency of the resin material, as illustrated in FIG. 6. Instead of a rib and groove, other interengaging means, well known in the art, such as a flexible overhanging latch, cooperating corrugated surfaces, or a friction-fit between mating parts may be employed.

Each of the front and rear members of the body 10 is approximately 0.09 inch (2.286 mm) thick and has recesses defined by shoulders 18 extending inwardly from the inner and outer faces and a relatively thin web 19 centrally of the outer edge portions or shoulders which is approximately 0.03 inch (0.762 mm) thick and between which a cavity or space 20 is provided. Although each of the first and second members 11 and 12 has been illustrated as having inner and outer recesses defined by shoulders 18, it is contemplated that inner recesses only could be provided in such members. Also, if desired, one of such first and second members could have an inner recess, while the other member has none.

As a result of making the first and second members from flexible resilient material of the approximate proportions, it will be apparent that the members will be bendable relatively easily at least laterally of the longitudinal dimension of the body. In order to facilitate opening of the members from the position of FIG. 1 to the position of FIG. 2, a corner portion 21 of one of the members, in the illustration the second or rear member 12, is enlarged so as to be exposed on both its front and rear faces. This is provided by forming the corner 21 of a thickness comparable to the combined thicknesses of members 11 and 12 and removing a corresponding corner from the member 11 along the portion 22. With such structure the corner 21 which is remote from the hinge 13 may be bent backwardly while the diagonally opposite corner is held, thereby separating the rib 14 from the groove 16.

A key retainer or strap 25 is provided which is generally circular in cross-section and has one end connected to the enlarged corner portion 21 of the second member 12. The opposite end of the retainer is embodied in a head 26 having a ledge portion or shoulder 27 where the head is connected to the strap of the retainer.

The head 26 may be circular in cross-section and in the illustrated embodiment may have a diameter of approximately 0.125 inch (3.175 mm), the strap portion having a diameter of approximately 0.075 inch (1.405 mm). The head is of a size which may pass through a relatively small opening in a key so that one or more keys may be conveniently mounted on the retainer.

In order removably to connect the head 26 to the body 10, the second member 12 has a recess with an enlarged portion 30 and a neck portion 31 of a size snugly to receive the head and adjacent portion of the strap of the retainer, with approximately one-half of the head and retainer extending outwardly from the face 33 of the member 12. Similarly the member 11 has a recess with an enlarged portion 35 which cooperatively receives a portion of the head 26 and a neck portion 36 which snugly receives the portion of the retainer adjacent to the head. Preferably the recess 30 and 31 is of slightly greater depth than the radius of the head and receives the head snugly or in an interference fit so that it may be temporarily positioned or retained within the recess 30 and 31 when the members 11 and 12 are separated, as in FIG. 2.

When the device is closed as in FIG. 1, the interfitting rib and groove 14 and 16 are snapped together. At the same time because of the width of the members 11 and 12, the closing force is applied through leverage to hold the facing portions of the members in which the recesses 30, 31 and 35, 36 are formed, adjacent to the hinge 13, together. In such position both of said recesses cooperate by engaging the head 26 of the retainer to hold it against inadvertent withdrawal. It is contemplated that the recess 30 and 31 of the second member could be sufficiently deep to accommodate the diameter of the head 26 in which case the recess in the first member could be eliminated.

In the operation of the device, the members 11 and 12 are separated by bending outwardly on the corner 21 to produce a flexing of the member 12 relative to the member 11 and facilitate separation of the rib and groove from a position beginning at the ends thereof adjacent to the corner 21 and progressing toward the opposite end. After the members are separated, the head is removed from the cooperating recesses and one or more keys are placed on the retainer, after which the head 26 is replaced in the recess 30, 31. Then the members are moved from the position shown in FIG. 2 to the position shown in FIG. 1 with the rib and groove being snapped together and the head being retained within the cooperating recesses.

If the key holder is made of transparent or translucent material, an identification card may be placed for viewing in the cavity 20 between the front and rear members.

I claim:

1. A key holder of flexible and resilient material for removably holding at least one key, comprising first and second members, hinge means connecting said members together along contiguous side edge portions thereof, one of said members having first engaging means extending along an edge portion which is remote from said hinge means, the other of said members having second engaging means extending along an edge portion thereof and which engages the first engaging means of said one member for holding said first and second members in facing abutting relationship, said first member having a corner portion removed adjacent to the side edge portion which is remote from the hinge means, the corner portion of said second member which is contiguous to said corner portion of said first member being exposed on both sides and may be grasped and bent away from said first member in order to separate said members, a retainer integrally connected at one end to said second member adjacent to said corner that is exposed on both sides thereof, said retainer having a head at its other end which is larger than the main body of said retainer, said second member having a recess adjacent to the hinged edge, said recess being configured for removably receiving a portion of said head and the adjacent portion of said retainer, said head and the adjacent portion of said retainer then being held jointly between said first and second members, whereby when said first and second members are closed together, the closing force applied at the sides of the members which are remote from the hinged portions acts through leverage to hold the head end of the retainer between the members.

2. The invention as defined in claim 1 including said first member having a recess which is configured for receiving a portion of said head and an adjacent portion of said retainer when said first and second members are in close facing relationship.

3. The invention as defined in claim 2, in which the recess in said second member is of a size and configuration to receive more than one-half of the head of said retainer, the recess in said first member being of a size and configuration to receive less than one-half of the head of said retainer, whereby the head may be releasably held in the recess in said second member when the first and second members are separated.

4. The invention as defined in claim 1 in which said corner portion of said second member that is exposed on both sides is enlarged to a thickness substantially corresponding to the thickness of the combined first and second members.

5. The invention as defined in claim 1, in which the first means is a groove, and the second means is a rib.

6. The invention as defined in claim 1 in which said rib has a reduced neck portion and said rib and said groove fit closely together in assembled relationship, the nature of the material permitting their engagement and disengagement.

7. A relatively thin flat key holder of flexible and resilient material for removably holding at least one key, comprising first and second members, hinge means connecting said members together along contiguous side edge portions thereof, one of said members having first means extending along an edge portion which is remote from said hinge means, the other of said members having second means extending along an edge portion thereof and which engages the first means of said one member for holding said first and second members in facing abutting relationship, said first member having a corner portion removed adjacent to the side edge portion which is remote from the hinge means, the corner portion of said second member which is contiguous to said corner portion of said first member being enlarged and exposed on both sides so that it may be grasped and bent away from said first member in order to separate said members, a retainer integrally connected to said corner portion of said second member, said retainer having a head at its other end which is larger than the main body of said retainer, said second member having a recess adjacent to the hinged edge, said recess being configured for removably receiving a portion of said head and the adjacent portion of said retainer, the first member having a recess which is configured for receiving a portion of said head and an adjacent portion of said retainer when said first and second members are in close facing relationship, said head and the adjacent portion of said retainer then being held jointly between said first and second members, whereby when said first and second members are closed together, the closing force applied at the sides of the members which are remote from the hinged portions acts through leverage to hold the head end of the retainer between the members and whereby the second member may be bent away from the first member in order lto facilitate separation thereof.

8. A key holder of flexible and resilient material comprising first and second body members, each of said body members having inner and outer faces, hinge means connecting said body members together along contiguous side edge portions thereof a shaped recess formed in the inner faces of each of said first and second body members adjacent said hinge means, one of said members having first fastening means disposed along at least a portion of and adjacent to an edge thereof which is remote from said hinge means, the other of said members having second fastening means disposed along at least a portion of and adjacent to an edge thereof remote from said hinge means, said first and second fastening means being cooperatively engageable with one another to lock said first and second members in facing overlaying relationship, an elongated retainer member connected at one end adjacent to an edge portion of said first member and removably interfittingly connected at its other end within said recesses and between said first and second body members, portions of said elongated retainer member between said ends thereof extending outwardly beyond the periphery of said first and second body members, a portion of an edge of said second body member remote from said hinge means extending inwardly with respect to the edge of said first body member whereby said first body member is exposed and may be engaged and bent away from said second body member in order to facilitate the separation of said body members.

* * * * *